US006216305B1

(12) United States Patent
Joh

(10) Patent No.: US 6,216,305 B1
(45) Date of Patent: Apr. 17, 2001

(54) PORTABLE APPARATUS FOR WASHING GOLF ACCESSORIES

(76) Inventor: William K. Joh, 6852 Vachon Dr., Bloomfield Hills, MI (US) 48301

( * ) Notice: Subject to any disclaimer, the term of this patent is extended or adjusted under 35 U.S.C. 154(b) by 0 days.

(21) Appl. No.: 09/268,111

(22) Filed: Mar. 15, 1999

Related U.S. Application Data

(60) Provisional application No. 60/094,725, filed on Jul. 30, 1998, provisional application No. 60/098,898, filed on Sep. 2, 1998, and provisional application No. 60/115,495, filed on Jan. 11, 1999.

(51) Int. Cl.[7] ..... A63B 47/04; A63B 57/00; B08B 1/00

(52) U.S. Cl. ..... 15/104.92; 15/104.94; 15/21.2; 15/210.1; 383/17; 383/22

(58) Field of Search ..... 15/21.2, 104.92, 15/104.93, 104.94, 160, 210.1; 206/315.9, 806; 383/17, 22

(56) References Cited

U.S. PATENT DOCUMENTS

| | | | | |
|---|---|---|---|---|
| 1,495,123 | * | 5/1924 | Waidich | 383/22 |
| 2,040,559 | * | 5/1936 | Luttrell | 383/22 |
| 2,493,681 | * | 1/1950 | Mayer . | |
| 2,530,746 | * | 11/1950 | Wetherby | 15/210.1 |
| 2,740,445 | * | 4/1956 | Fornell | 383/22 |
| 2,968,825 | * | 1/1961 | Wetherby | 15/210.1 |
| 3,806,983 | * | 4/1974 | Cunningham | 15/21.2 |
| 4,011,619 | | 3/1977 | Michalak . | |
| 4,069,536 | | 1/1978 | Hartz et al. . | |
| 4,163,299 | | 8/1979 | Duda . | |
| 4,210,974 | | 7/1980 | Stoltzman . | |
| 4,350,457 | | 9/1982 | Carnahan . | |
| 4,380,839 | | 4/1983 | Caradonna . | |
| 4,464,072 | * | 8/1984 | Norwell | 15/21.2 |
| 4,701,968 | | 10/1987 | Stoltzman . | |
| 4,821,358 | | 4/1989 | Wykoff et al. . | |
| 4,899,413 | | 2/1990 | Trobiani . | |
| 4,944,063 | | 7/1990 | Jordan . | |
| 5,075,918 | * | 12/1991 | Zeltner | 15/210.1 |
| 5,161,853 | * | 11/1992 | Polett | 383/17 |

(List continued on next page.)

FOREIGN PATENT DOCUMENTS

| | | | | |
|---|---|---|---|---|
| 0007955 | * | of 1915 | (GB) | 15/21.2 |
| 867107 | * | 5/1961 | (GB) | 383/22 |

*Primary Examiner*—Randall E. Chin
(74) *Attorney, Agent, or Firm*—Carrier, Blackman & Associates, P.C.; Joseph P. Carrier; William D. Blackman

(57) ABSTRACT

A washing apparatus for golfers, comprises: a flexible container for containing washing liquid and for receiving objects to be washed therein, a handle connected to the container for manipulating same; and a support mechanism for suspending the container and the handle from a golf bag and for restricting movement of the container relative to the golf bag when suspended therefrom. The container includes an access opening defined therein through which objects such as golf club heads may be inserted, a closure for selectively sealing the opening, at least one flap extending away from the closure, a brush disposed within said container for scrubbing against objects inserted into the container during a washing operation, and (optionally) a baffle for baffling movement of the washing liquid toward the opening after the liquid is placed in the container. The handle is operatively connected to the container flap. The support mechanism includes a clip member for suspending the handle from a rim of a golf bag and which normally urges the container toward the golf bag when suspended therefrom to restrict movement of the container, while the support mechanism may optionally include a pouch in which said container is disposed and which operatively cooperates with the clip member to restrict movement of the container. When the pouch is used, the handle is also connected to said pouch. The several components of the washing apparatus are preferably separable from each other for cleaning, storage, selective replacement, etc.

16 Claims, 5 Drawing Sheets

U.S. PATENT DOCUMENTS

| | | | | |
|---|---|---|---|---|
| 5,215,136 | | 6/1993 | Flanders et al. . | |
| 5,339,486 | | 8/1994 | Persic, Jr. . | |
| 5,400,455 | | 3/1995 | Crossley . | |
| 5,524,311 | | 6/1996 | Crossley . | |
| 5,533,225 | | 7/1996 | Ellis . | |
| 5,555,586 | | 9/1996 | Dorrich et al. . | |
| 5,638,567 | | 6/1997 | Danyluk . | |
| 5,641,232 | | 6/1997 | Frey . | |
| 5,647,082 | | 7/1997 | Garske et al. . | |
| 5,711,330 | | 1/1998 | Nelson . | |
| 5,758,379 | | 6/1998 | Hovnanian . | |
| 5,770,284 | * | 6/1998 | Logemann | 15/210.1 |
| 5,806,122 | | 9/1998 | Bogle et al. . | |
| 5,829,086 | | 11/1998 | Billek . | |
| 5,898,968 | * | 5/1999 | Beattie | 15/210.1 |

* cited by examiner

PORTABLE APPARATUS FOR WASHING GOLF ACCESSORIES

CROSS-REFERENCE TO RELATED APPLICATIONS

This application claims priority under 35 USC §119(e) from U.S. Provisional Patent Application No. 60/094,725 filed Jul. 30, 1998, U.S. Provisional Patent Application No. 60/098,898 filed Sep. 2, 1998, and U.S. Provisional Patent Application No. 60/115,495 filed Jan. 11, 1999, the disclosures of which are incorporated by reference.

BACKGROUND OF THE INVENTION

1. Field of the Invention

The present invention relates to an apparatus for conveniently washing golfing equipment, such as golf club heads and golf balls. More particularly, the present invention relates to a portable apparatus of the type described, which is readily attachable to a golf bag for use in the field.

2. Description of the Background Art

Many devices are known for washing golf club equipment. Examples of the previously known devices may be found in U.S. Pat. No. 4,011,619 (Michalak), U.S. Pat. No. 4,069,536 (Hartz), U.S. Pat. No. 4,163,299 (Duda), U.S. Pat. No. 4,210,974 (Stoltzman), U.S. Pat. No. 4,350,457 (Carnahan), U.S. Pat. No. 4,701,968 (Stoltzman), U.S. Pat. No. 4,821,358 (Wyckoff), U.S. Pat. No. 4,89,413 (Trobiani), U.S. Pat. No. 4,944,063 (Jordan), U.S. Pat. No. 5,215,136 (Flanders), U.S. Pat. No. 5,339,486 (Persic), U.S. Pat. No. 5,400,455 (Crossley), U.S. Pat. No. 5,524,311 (Crossley), U.S. Pat. No. 5,533,225 (Ellis), U.S. Pat. No. 5,555,586 (Dorrich), U.S. Pat. No. 5,638,567 (Danyluk), U.S. Pat. No. 5,641,232 (Frey), U.S. Pat. No. 5,647,082 (Garske), U.S. Pat. No. 5,711,330 (Nelson), U.S. Pat. No. 5,758,379 (Hovnanian), U.S. Pat. No. 5,806,122 (Bogle), U.S. Pat. No. 5,829,086 (Billek). A washing device for golf club heads is also disclosed in applicant's prior U.S. Pat. No. 5,465,840.

Although the known devices are generally effective for their intended purposes, a need still exists in the art for a highly versatile, yet structurally simple, durable and easy to use washing apparatus for golfing equipment, which is unobtrusively attachable to a golf bag to allow convenient washing of the equipment by golfers while golfing on a golf course.

SUMMARY OF THE INVENTION

According to one aspect of the invention, there is provided washing apparatus for golfers, comprising: a flexible container for containing washing liquid and for receiving objects to be washed therein; handle means operatively connected to the container for manipulating the container; and support means for suspending the container and the handle means from a golf bag and for restricting movement of the container relative to the golf bag when suspended therefrom.

With such structure according to the invention, the flexible container may be of a sufficiently large sized to easily accommodate even the club head of a driver for washing purposes, yet it is simply suspended from the golf bag and is otherwise non-obtrusive when not being used because of its restricted movement relative to the bag and because the flexible container can assume a narrow profile when not in use.

Preferably, the container includes an access opening defined therein through which objects such as golf club heads may be inserted, closure means for selectively sealing the opening, at least one flap extending away from the closure means, abrasive means disposed within the container for scrubbing against objects inserted into the container during a washing operation, and baffling means for baffling movement of the washing liquid toward the opening after the liquid is placed in the container; and the handle means preferably includes a handle operatively connected to the flap.

Also preferably, the support means includes a clip member for suspending the handle means from a rim of a golf bag and which normally urges the container toward the golf bag when suspended therefrom to restrict movement of the container, while the support means may optionally include a pouch in which the container is disposed and which operatively cooperates with the clip member to restrict movement of the container. When the pouch is used, the handle means is also operatively connected to the pouch.

Still further, the several components of the washing apparatus are preferably separable from each other for cleaning, storage, selective replacement, etc.

According to a second aspect of the invention, an apparatus is provided for washing golf accessories, comprising: a pouch member defining an internal space therein, the pouch member having first and second opposed flaps thereon, each flap comprising a hollow sleeve; first and second support braces, each support brace having an arm which fits into a sleeve of the pouch member and a loop integrally attached to the arm and defining an aperture therein; and a sealable bag for holding a washing solution therein, the bag fitting into said internal space in the pouch member.

With the apparatus according to the second aspect of the invention, the overall apparatus is economical to produce and simple to use. For example, the sealable bag may be constructed as an inexpensive, disposable plastic bag because it is supported in the pouch, while the braces function as simple handles for pouch and may be selectively removed from the pouch for replacement or for cleaning purposes.

According to the second aspect of the invention, the sealable bag also preferably includes a pair of opposed flaps which are respectively connected to the first and second flaps of the pouch such that the pouch and bag flaps are movable together; and the apparatus preferably further comprising a support hook member for attaching to a golf bag and for suspending the braces, pouch and bag therefrom, and means disposed within the bag for scrubbing a golf accessory As may be understood from the foregoing, it is an object of the present invention to provide a portable apparatus for washing golfing equipment, including club heads and golf balls, which may be conveniently and efficiently used by golfers during the course of a game for cleaning their equipment, and which is also simple in structure, compact in size and unobtrusively supported on a golf bag.

It is another object of the invention to provide such a washing apparatus comprising a few components which may be readily assembled together for use and readily disassembled for storage, cleaning, etc.

Yet another object of the invention to provide such an apparatus which is economical to produce, and having readily separable components, including a main container component, that may be individually replaced as desired or necessary.

For a more complete understanding of the present invention, the reader is referred to the following detailed description section, which in conjunction with the accompanying drawings, describes the presently preferred embodiments of the invention. Throughout the following detailed description and in the drawings, like numbers refer to like parts.

DETAILED DESCRIPTION OF THE PRESENTLY PREFERRED EMBODIMENTS

Figure 1:
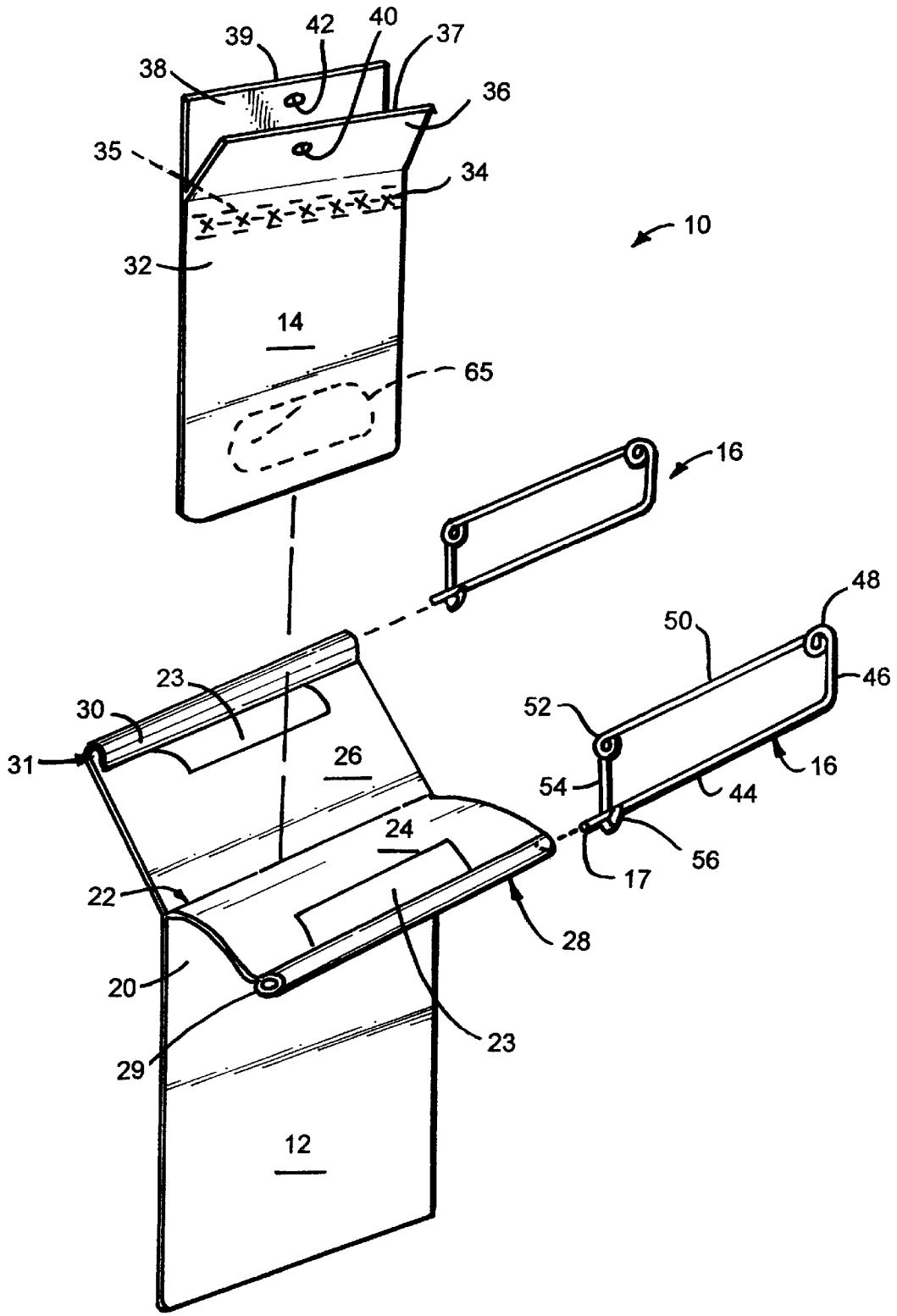
FIG. 1 is an exploded perspective view of a golf accessory washing apparatus in accordance with a first embodiment of the present invention.

Referring now to FIGS. 1–3, 6 and 7 of the drawings, an apparatus for washing golf accessories is shown generally at 10. The apparatus 10 is an assembly which includes an (optional) external pouch 12, a flexible, sealable, water impermeable internal bag 14 and a pair of identical support braces or handles 16, each of which will be described in further detail hereinbelow. The apparatus 10 also preferably includes a hook member 18 (FIG. 2) for attaching to a golf bag (not shown), cords 58, 60 (FIG. 3) which are joined to the braces 16 for use together therewith, and abrasive means (FIG. 7) such as a scrubbing brush 62. Collectively, the braces 16 and cords 58, 60 are a handle means of the invention; while collectively the hook member 18 and the external pouch are a support means of the invention.

The apparatus 10 is usable, in particular, to wash golf club heads and golf balls while a user is out in the field, such as on a golf course. Optionally, the apparatus may include an optional golf ball bracket 80 (FIG. 4) for placement in the bag 14 to support a golf ball therein such that the ball may be easily handled while being washed in the bag 14.

The External Pouch

Figure 5:
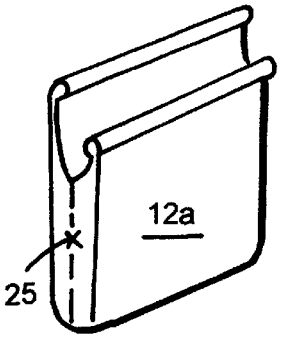
FIG. 5 is an alternative modified version of a pouch member which is a component of the apparatus of FIG. 1.

The external pouch 12 is a generally oblong rectangular member, formed of a durable fabric such as woven nylon or the like, which is sewn, sealed or otherwise closed around three sides thereof, and which is open at the top end 20 thereof. The pouch 12 defines an internal space 22 therein for receiving the bag 14. The pouch 12 includes two opposed flaps 24, 26 extending upwardly thereon at the top end 20 thereof. Each of the flaps 24, 26 is turned over and attached to itself at the outermost extension thereof to form sleeves 28, 30. The sleeves 28, 30 define internal channels 29, 31, respectively, which are provided to each receive a portion of a support brace 16 therethrough. Optionally, as shown in the modified embodiment of FIG. 5, a pouch 12*a* may be provided with foldable gussets 25 along the sides thereof for greater capacity.

Figure 10:
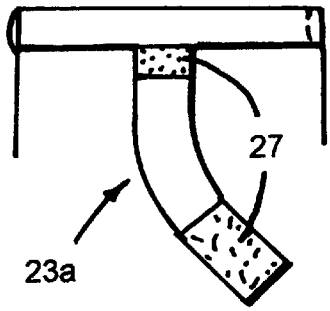
FIG. 10 is a detail perspective view of an alternative variant of the pouch member of FIG. 1, shown partially broken away.

The pouch 12 also preferably includes means for connecting the pouch flaps 24, 26 to corresponding flaps 36, 38 of the bag 14. Such connecting means may comprise cloth strips 23 respectively attached to the inside of the flaps 24, 26 parallel to the sleeves 28, 30, as shown in FIG. 1, and safety pins (not shown) for joining the bag flaps 36, 38 to the pouch flaps 24, 26 such that the flaps may be manipulated together. Alternatively, a strip 23*a* with hook-and-loop fastener material 27 thereon, as shown in FIG. 10, may be used instead of the strips 23 and safety pins, and in such case the bag flaps 36, 38 will have openings 40, 42 (see FIG. 1) defined therein through which the strips 23*a* may be inserted.

Figure 6:
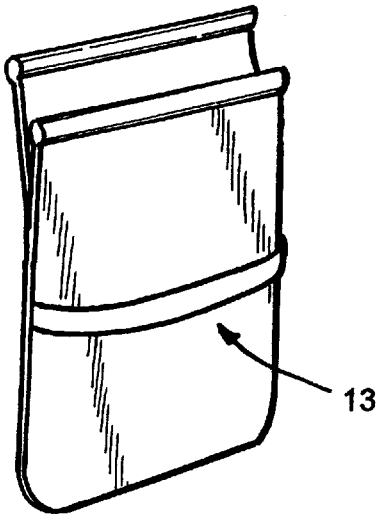
FIG. 6 is a perspective view of the pouch member of FIG. 1, shown from the opposite direction as the view of FIG. 1.

The pouch 12 may also have a fabric band or strap 13 attached to the middle section of the outer surface thereof, and extending thereacross, as shown in FIG. 6. The strap 13 receives a long portion 21 of the hook member 18 therethrough so as to minimize movements of the pouch 12 away from a golf bag when suspended from the hook member 18.

The Bag Member

The water impermeable flexible internal bag 14 is preferred to be formed in an elongated, substantially rectangular shape, and is dimensioned to fit snugly within the pouch 12. The bag 14 is preferably formed of a liquid impermeable material such as thin plastic, and is suitable for holding a cleaning solution therein for extended time periods without leaking. The bag 14 includes an upper end 32 having a sealable closure means 34 integrally formed therein to resist leakage from the bag when closed. The closure means 34 is preferred to include a zippably closable interference closure 35, of the known type which is used in conjunction with food storage bags, extending across the bag 14. The closure means may optionally include two such zippably closable members which are parallel to one another. The upper end 32 of the bag 14 also includes the two opposed flaps 36, 38 which have the respective holes 40, 42 formed centrally therein, adjacent the upper edges 37, 39 thereof. The pouch 12 provides significant support for the bag 14, such that the bag need not be formed to have great strength and durability, and it is contemplated that the bag 14 could be selectively replaced as it becomes worn because it is not expensive to produce.

The Support Braces

Figure 3:
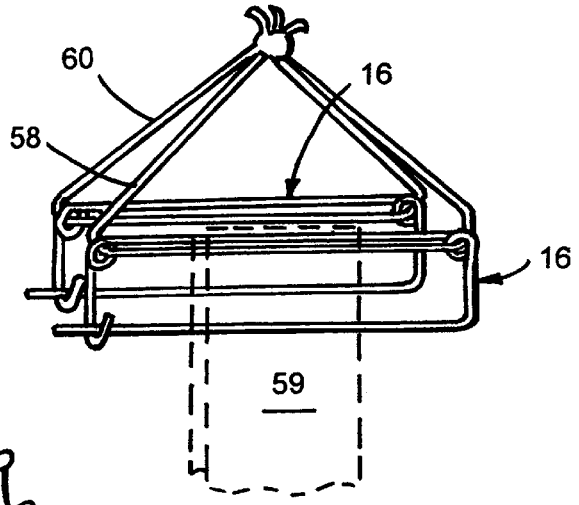
FIG. 3 is a perspective view of a pair of brace members and a pair of support cords in accordance with the first embodiment of the invention, with an optional towel shown in phantom.

The support braces 16, 16 may be made of an extended filament 17 of spring wire or strong plastic, and are provided for use as handles in manipulating the pouch 12 and bag 14 and for supportively attaching the apparatus 10 to a golf bag. As shown, each support member 16 preferably includes a substantially straight lower segment 44 for sliding into one of the sleeves 28 or 30 of the pouch 12. At the end of the lower segment 44, the filament 17 curves upwardly in a right angle to a first side section 46, and then coils upon itself to form a first ear hole 48. The filament 17 of the brace 16 then continues across in an upper segment 50 which is substantially parallel to the lower segment 44, until at the end of the upper segment 50, it again coils upon itself to form a second ear hole 52. The filament 17 then extends downwardly in a second side section 54 parallel to, and opposite the first side section 46. At the lowermost end of the second side section 54, the filament 17 curves upwardly in a hook portion 56 to engagingly surround an end portion of the first segment 44, as shown. With such preferred structure, the braces can be readily connected to and removed from the sleeves 28, 30 as desired for assembly, storage, replacement, cleaning of the pouch, etc. Referring now to FIG. 3, the cords 58, 60 are preferably used together with the braces 16 as the handle means. The cord 58 is connected to one brace 16 by being extended through the first and second ear holes 48, 52. Then, the second cord 60 is placed through the first and second ear holes 48, 52 of the second brace 16. Thereafter, the free ends of the first and second cords 58, 60 may be knotted together, as shown. If desired the cords 58, 60 could be omitted, while the braces 16 could be formed with other shapes than rectangular, such as trapezoidal, triangular, etc.

In assembling the pouch 12 to the braces 16, the lower segment 44 of a support brace 16 is first disengaged from the hook portion 56 of the brace, and the free end of the lower segment is then inserted into a channel 29 of a sleeve 28. The lower segment is slidably placed through the sleeve 28 until the free end protrudes through the opposite side of the sleeve 28. The free end of the lower segment is then re-engaged with the hook portion to fasten the brace in engagement with the flap 24 of the pouch 12. The above-described process is repeated to engage a second support brace 16 in the sleeve 30 of the second flap 26. A towel 59 may conveniently be secured between cord 58 or 60 and a corresponding one of the braces, and subsequently used in a cleaning operation.

The Hook Member

Figure 2:
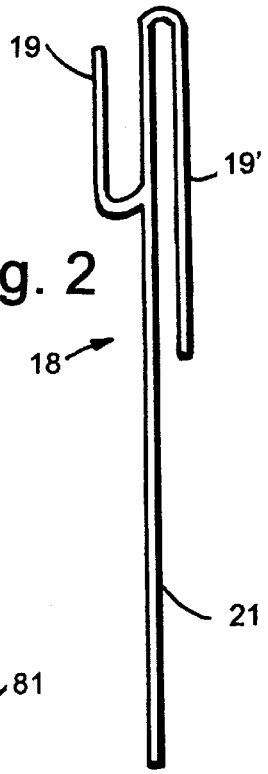
FIG. 2 is a side elevational view of a mounting member according to the first embodiment of the invention.

The hook member 18 is used to support or suspend the apparatus 10 from the lip of a golf bag. With reference to FIG. 2, the hook member preferably is constructed of resilient plastic or spring metal wire, and includes one hooked portion 19 onto which the cords 58, 60 may be placed for being suspended therefrom, another hooked portion 19' opposite to the one hooked portion 19 for being secured onto the rim of a golf bag at any appropriate location, and the long portion 21 which is received through the pouch strap 13. In use the hooked portion 19' is disposed inside the golf bag and functions to securely clamp onto bag's upper rim, while the hooked portion 19 and the long portion 21 are disposed outside of the bag such that the long portion engages the backside of the pouch 12 and is received by the strap 13 so that the pouch is restricted from moving away from the bag, and the handle means are hung on the hooked portion 19.

The Abrasive Means

Figure 7:
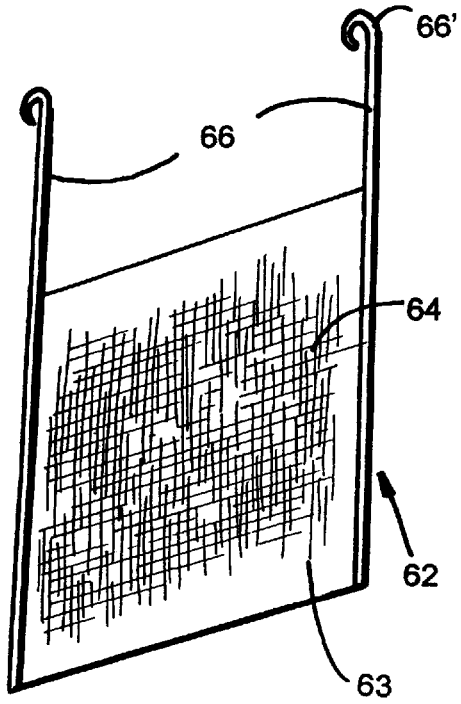
FIG. 7 is an optional brush board for use with the apparatus of FIG. 1.

With reference to FIG. 7, the abrasive means preferably includes a pair of the scrubbing brushes 62. Each brush 62 preferably includes a rectangular plate 63 made of flexible plastic, from one face of which a mass of bristles 64 extend, and a pair of handles 66 extending in parallel from the two corners of one edge of the plate. Further, each of the handles preferably has a hook 66' formed in the free end thereof. The hooks 66' of each brush 62 may selectively be engaged in the ear holes 48, 52 of a corresponding one of the braces 16 such that the plate 63 is suspended within the bag 14 through the opening thereof for use in a cleaning operation. Particularly, when thus suspended from the braces, the bristles 64 on the pair of brushes 62 will face each other, and as an object such as a club head is repeatedly moved up and down within the bag, the bristles scrub the object in an efficient manner. When not in use the hooks 66' are disengaged from the ear holes and the brushes 62 are disposed fully within the bag 14 together with the washing liquid.

A mildly abrasive scrubbing sponge 65 (FIG. 1) may, optionally, be placed into the bag in place of, or in addition to, the brush plates 62. Where used, the sponge 65 is placed in the washing fluid within bag 14 and is manipulated by the hand of a user, to generate a scrubbing motion against the ball or club head to be washed.

As will be understood from the foregoing descriptions of the several components of the apparatus 10, the components are easily assembled and disassembled relative to each other, which is desirable for storage, cleaning, selective replacement, etc.

Ball Washing Apparatus

Figure 4:
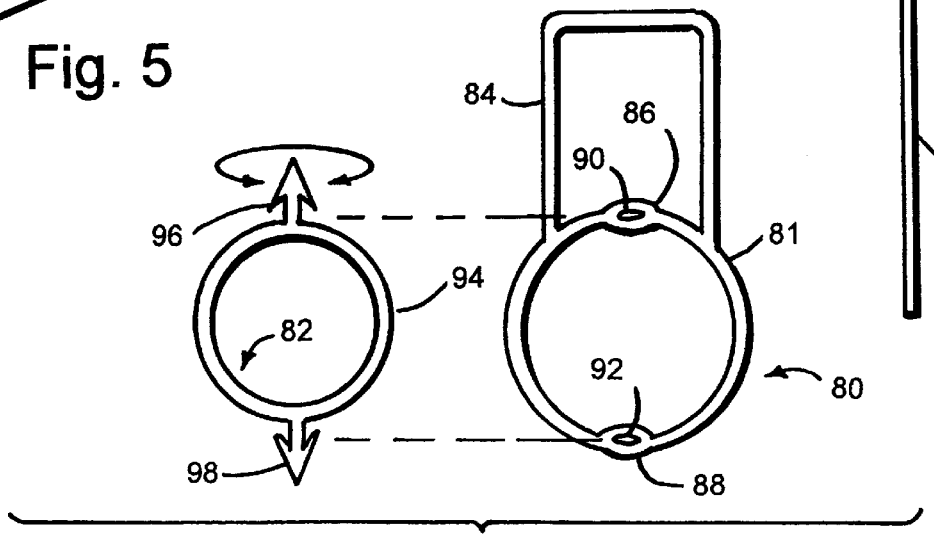
FIG. 4 is a side elevational view of an accessory golf ball bracket for use in the assembly according to the invention.

Turning now to FIG. 4, an optional golf ball washing apparatus according to a preferred embodiment of the invention is disclosed. The ball washing apparatus preferably includes a bracket 80 made of plastic or metal. The bracket 80 includes an outer section 81 and an inner section 82, which is rotatably connectable to the outer section.

The outer section includes a handle 84 attached to an integrally formed annular portion 86. The annular portion 86 of the outer section 81 has a pair of opposed integral hole plates 88, 90 at the top and bottom thereof, and the hole plates are provided with respective bracket mounting holes 90, 92.

The inner section 82 includes a circular band 94 having arrow-shaped projections 96, 98 extending outwardly thereon at the top and bottom thereof, which extend through the bracket mounting holes 90, 92 of the outer section, attaching the inner section thereto to form rotational hinges.

A golf ball (not shown) may be placed into the assembled bracket 80 and is held securely within the circular band 94 of the inner section 82. The bracket and golf ball may then be placed inside of the bag 14, and the outside of the pouch 12 may be manually manipulated to assist in cleaning the golf ball. Wiping the golf ball on a towel after its removal from the apparatus 10 also provides added cleaning benefit.

Modified Embodiments and Optional Accessories

Figure 8:
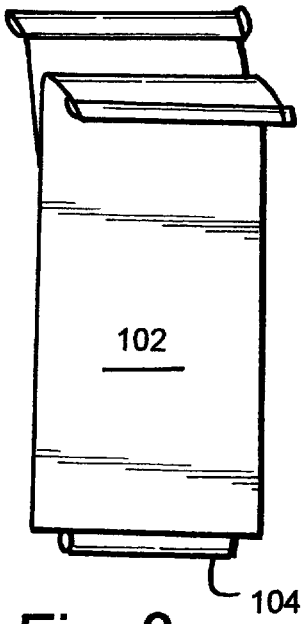
FIG. 8 is a perspective view of another alternative modified pouch member usable as a part of the apparatus of FIG. 1.
Figure 9:
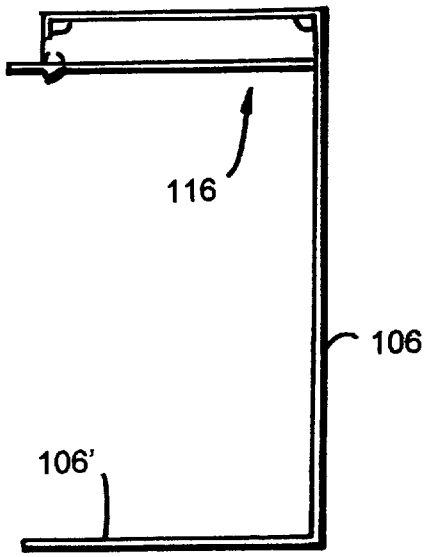
FIG. 9 is a side elevational view of an alternative modified brace member for use together with the pouch member of FIG. 8.

Referring to FIGS. 8 and 9, there is shown a pouch 102 and a brace 116 according to a second preferred embodiment of the present invention, which are structurally and functionally identical to the pouch 12 and brace 16 of the first preferred embodiment except that the pouch 102 has a third sleeve 104 at the bottom thereof, and that the brace 116 has an L-shaped extension 106 with a portion 106' that is received in the third sleeve 104 when the brace is assembled to the pouch for additional support.

Figure 11:
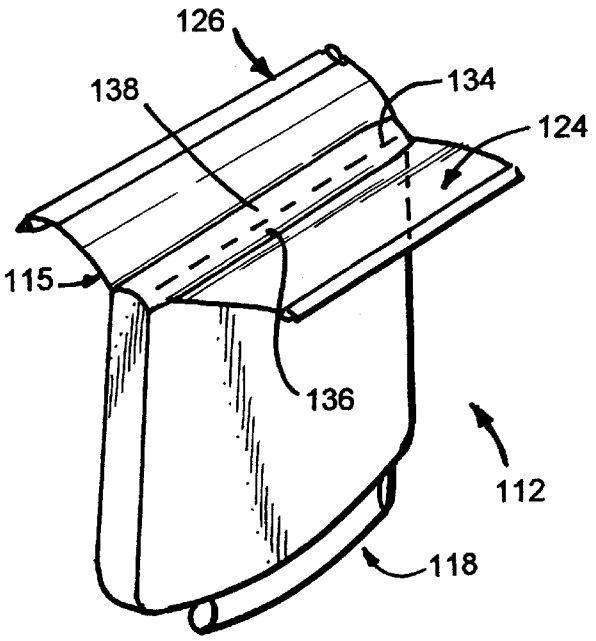
FIG. 11 is a perspective view of a third embodiment of the invention, which eliminates the pouch member of FIG. 1, shown in a position with the flaps open.
Figure 12:
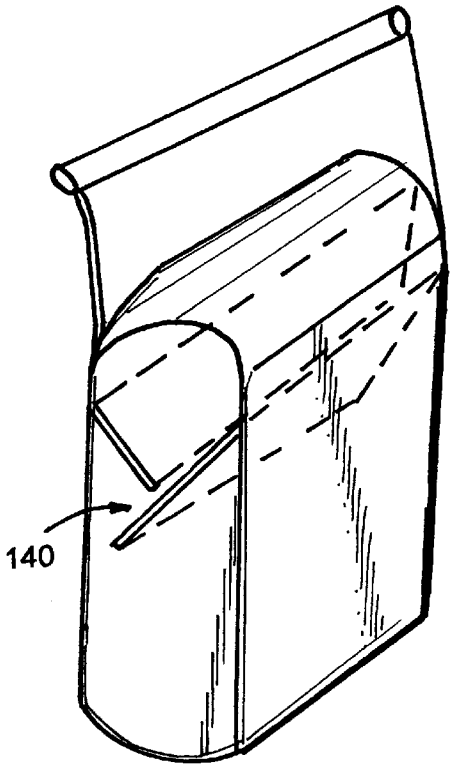
FIG. 12 is a perspective view of the embodiment of FIG. 11, with the right side flap omitted for purposes of illustration, and showing an internal baffling device in phantom.
Figure 13:
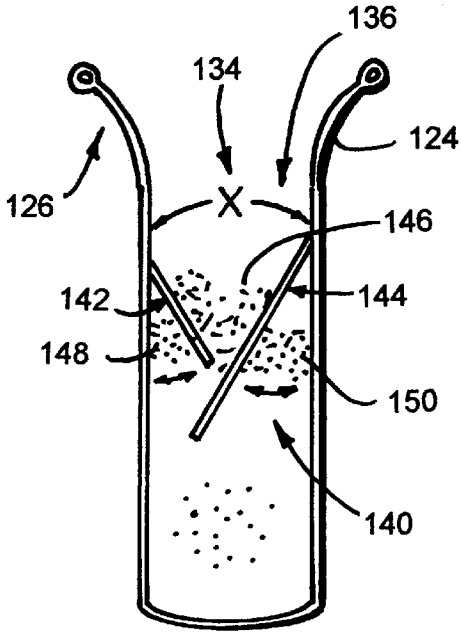
FIG. 13 is a cross-sectional view of the embodiment of FIGS. 11–12.

Referring now to FIGS. 11–13, a pouch member and bag according to a third preferred embodiment of the invention are shown combined in a single container 112 to replace, and to serve the functions previously served by both the pouch 12 and bag 14 or the first embodiment 10, in a modified alternative apparatus according to the invention. The container 112 of FIGS. 11–13 is made of a more durable flexible resilient material, preferably a tough and flexible plastic. The container 112 is sealed and impervious to liquid at all points thereof except the top section 115 thereof. The container 112 includes first and second outer flaps 124 and 126, which are substantially identical to the pouch flaps 24, 26 as described herein. This container 112 may also, optionally, include a sleeve 118 on the bottom end thereof, if desired, so as to be usable with the support brace 116 of FIG. 9.

The container 112 in this embodiment also has a pair of opposed lips 136, 138 inside the flaps 124, 126 which are sealably closable together by the use of a sealing closure 134 similar to the closure 34 as previously described.

The container 112 is attached to a golf bag in the same way as previously described in connection with the first embodiment, using two of the support braces 16 or 116 in connection with appropriate cords such as those shown at 58, 60 in FIG. 3.

The container 112 preferably includes a baffle 140 to resist spillage therefrom. The baffle 140 is a resilient and flexible rectangular polymer structure, and includes opposed first and second baffle plates 142, 144 extending diagonally inwardly from the top corner edges of the container 112 as shown in FIG. 13. The plates 142, 144 may have integral brushes 146 formed thereon, as shown, in which case the brushes 62 of FIG. 7 are not used. Rubbery sponge or urethane foam biasing members 148, 150 may be provided between the side walls of the container 112 and the baffle plates 142, 144 as shown.

Figure 14:
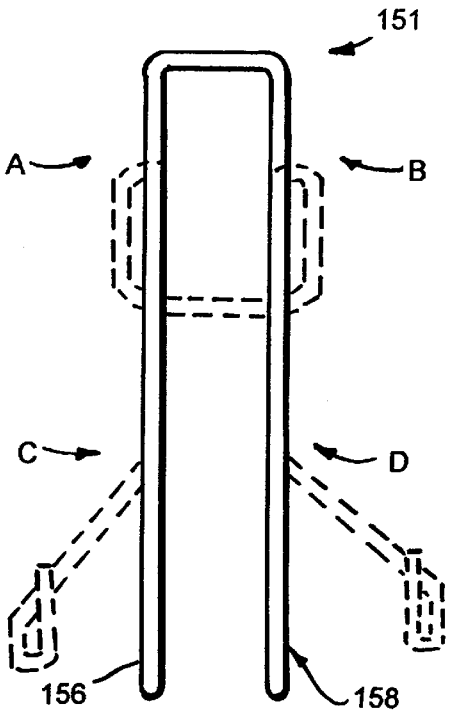
FIG. 14 is a front elevational view of a wire section, showing the completed configuration of an optional mounting bracket usable with the apparatus of FIG. 1 in phantom, which optional bracket may be formed from the wire section of FIG. 14.
Figure 15:
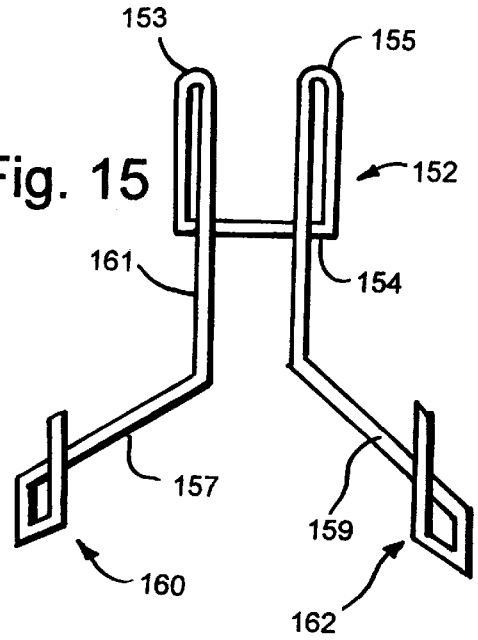
FIG. 15 is a side elevational view of the optional mounting bracket.

Referring now to FIGS. 14 and 15, an optional bracket is shown at 152. This optional bracket 152 may be provided for use with the apparatus 10 of FIG. 1, replacing the cords 58, 60 and the hook member 18. This bracket 152 may be formed of wire or a strong plastic material. A strong wire is preferred in the practice of the present invention because of its malleability.

FIG. 14 is provided to help the viewer to see the spatial relation of selected portions of the bracket 152 relative to an inverted substantially U-shaped frame member 151, which may be an intermediate step in forming the bracket. Four bend points are shown at A, B, C, and D in FIG. 14, where the frame member 151 may be bent to form the bracket 152.

At points A and B, the frame member 151 is bent backwardly at approximately 180 degrees to form a large clip portion 154, forming arcuate high points or apices 153, 155 at points A and B of the frame member 151. The clip portion 154 of the bracket 152 extends downwardly from the arcuate apices 153, 155, and this configuration of the bracket 152 allows it to be slidably mountable on an upper edge of a golf bag (not shown) in the final use thereof.

The frame member extends downwardly from the arcuate apices 153, 155 in a center section 161 of the bracket 152. At points C and D of the original frame member 151, respective legs 156, 158 thereof are bent outwardly in opposite directions, forming opposed wing portions 157, 159 which are oriented at obtuse angles with respect to the center section 161 of the bracket, as shown. Then, each of the tip ends of the legs 156, 158 is bent forward, curved around, and oriented pointing upwardly to form respective hooks 160, 162 to receive the ear holes 48, 52 of the brace members 16 thereon, and to mount the brace members 16 on the bracket 152. Preferably, a stopper (not shown) is inserted between each respective ear hole 48, 52 and its respective hook 160 or 162. Where used, the stoppers are provided to stabilize the brace members 16 on the bracket 152, and to reduce the chance of both brace members 16 slipping off of the hooks 160, 162, when a first brace member 16 is manually lifted off of the hooks to open the pouch 12 and the bag 14 for a washing and cleansing operation.

Figure 16:
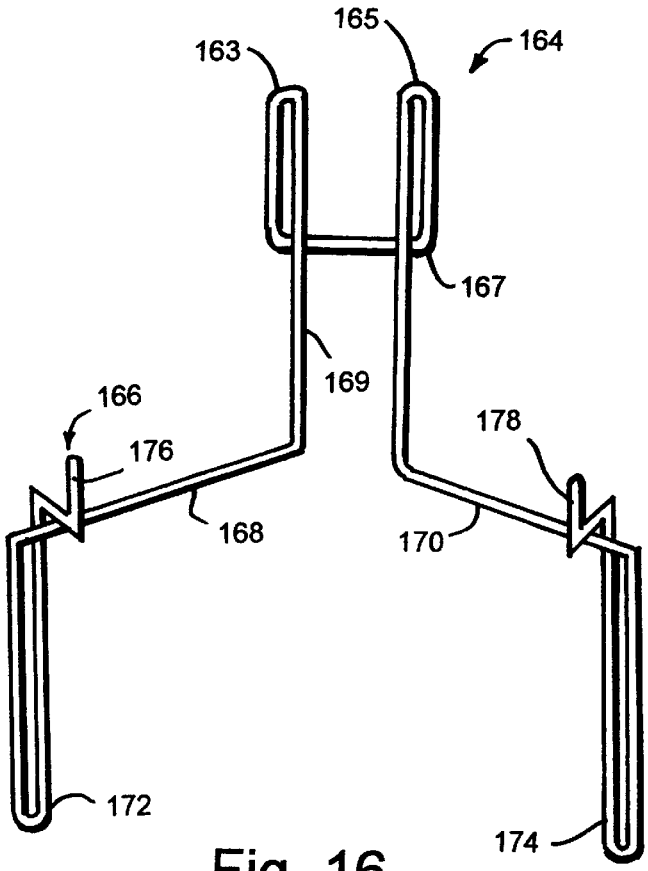
FIG. 16 is a side elevational view of a further modified version of the optional mounting bracket.

Also, in FIG. 16, a further modified version of a bracket is shown at 164. The further modified bracket 164 is similar to the bracket 152 of FIG. 15, including a a pair of arcuate apices 163, 165 and a clip portion 167 which extends downwardly from the arcuate apices 163, 165. The bracket 164 also includes a center section 169 extending downwardly from the apices 163, 165 of the bracket 164 substantially parallel to the clip portion 167 and continuing on beyond the clip portion. The bracket 164 also includes a pair of opposed wing portions 168, 170 which are bent outwardly in opposite directions from the center section 169 and which are oriented at obtuse angles with respect to the center section, as shown. The further modified bracket 164 differs from the bracket 152, in that, instead of the filament 166 simply curving around to form hooks at the ends of the respective wing portions 168, 170, in this embodiment, the filament 166 is made longer than in the bracket 152, and it extends downwardly at the respective end of each outwardly bent wing portion 168, 170 to form opposed depending fingers 172, 174 for placement inside of the strap 13 on the pouch 12.

The filament then curves back upwardly and crosses over the wing portions 168, 170 to form hooks 176, 178 located at the ends of the wing portions. In a manner similar to the bracket 152 of FIG. 15, the hooks 176, 178 are provided to supportively receive the ear holes 48, 52 of the brace members 16 thereon, and to thereby mount the brace members 16 thereon.

Once again, in this embodiment, preferably, a stopper (not shown) is inserted between each respective ear hole 48, 52 and its respective hook 176 or 178. Where used, the stoppers are provided to stabilize the brace members 16 on the bracket 164, and to reduce the chance of both brace members 16 slipping off of the hooks 176, 178, when a first brace member 16 is manually lifted off of the hooks to open the pouch 12 and the bag 14 for a washing and cleansing operation.

Although the present invention has been described herein with respect to a preferred embodiment thereof, the foregoing description is intended to be illustrative, and not restrictive. Those skilled in the art will realize that many modifications of the preferred embodiment could be made which would be operable. For example, the bag 14 of the first embodiment could be formed with a baffle and integral bristles, etc. such as in the container 112 of the third embodiment. All such modifications which are within the scope of the claims are intended to be within the scope and spirit of the present invention.

I claim:

1. Washing apparatus for golfers, comprising:

a flexible container formed of a liquid impermeable material for containing washing liquid and for receiving objects to be washed therein;

handle means operatively connected to said container for manipulating the container;

support means for suspending said container and said handle means from a golf bag and for restricting movement of the container relative to the golf bag when suspended therefrom; and a support brace connected to said handle means and a towel secured by said support brace.

2. Washing apparatus for golfers, comprising:

a flexible container for containing washing liquid and for receiving objects to be washed therein;

handle means operatively connected to said container for manipulating the container; and support means for suspending said container and said handle means from a golf bag and for restricting movement of the container relative to the golf bag when suspended therefrom;

said support means including a clip having a first hooked portion adapted to securely engage a rim of a golf bag and a second hooked portion operatively connected to said handle means such that the handle means and said container are suspended from said second hooked portion.

3. Washing apparatus for golfers, comprising:

a water impermeable flexible container for containing washing liquid and for receiving objects to be washed therein;

handle means operatively connected to said container for manipulating the container; and support means for suspending said container and said handle means from a golf bag and for restricting movement of the container relative to the golf bag when suspended therefrom;

said support means including a pouch in which said container is disposed, and said handle means also being operatively connected to said pouch, and said support means further includes a means for suspending the handle means from the golf bag.

4. Washing apparatus according to claim 3, wherein said pouch includes a recess in which the container is disposed, at least one flap extending away from said recess; and said handle means includes a handle operatively connected to the flap for manipulating the flap.

5. Washing apparatus according to claim 4, wherein said pouch includes a pair of said flaps, and said handle means includes a pair of handles which are connected to said flaps, respectively.

6. Washing apparatus according to claim 3, wherein said suspending means includes a clip having a first hooked portion adapted to securely engage a rim of a golf bag and a second hooked portion operatively connected to said handle means such that the handle means are suspended therefrom.

7. Washing apparatus for golfers, comprising:

a flexible container for containing washing liquid and for receiving objects to be washed therein;

handle means operatively connected to said container for manipulating the container;

support means for suspending said container and said handle means from a golf bag and for restricting movement of the container relative to the golf bag when suspended therefrom; and abrasive means disposed within said container for scrubbing against objects inserted into the container during a washing operation.

8. Washing apparatus for golfers, comprising:

a flexible container for containing washing liquid and for receiving objects to be washed therein;

handle means operatively connected to said container for manipulating the container;

support means for suspending said container and said handle means from a golf bag and for restricting movement of the container relative to the golf bag when suspended therefrom; and said container including an opening, closure means for selectively sealing the opening, and baffling means for baffling movement of the washing liquid through said opening after the liquid is placed in the container.

9. An apparatus for washing golf accessories, comprising:

a pouch member defining an internal space therein, said pouch member having first and second opposed flaps thereon, each flap comprising a hollow sleeve;

first and second support braces, each support brace having an arm which fits into a sleeve of said pouch member and a loop integrally attached to said arm and defining an aperture therein; and a sealable bag for holding a washing solution therein, said bag fitting into said internal space in said pouch member.

10. The apparatus of claim 9, further comprising support braces connected to said handle means, and a support hook member operably connected to said support braces for attaching to a golf bag and for supporting the apparatus.

11. The apparatus of claim 9, further comprising means disposed within said bag for scrubbing a portion of a golf accessory.

12. The apparatus of claim 9, further comprising a removable golf ball support bracket disposed within said bag for supporting a golf ball within said bag.

13. A washing apparatus according to claim 9, wherein the sealable bag also includes a pair of opposed flaps which are respectively connected to the first and second flaps of the pouch such that the pouch and bag flaps are movable together.

14. The washing apparatus of claim 9, further comprising comprising a support brace connected to said handle means and a towel secured by said support brace.

15. The washing apparatus of claim 9, further comprising a bracket operably attached to said support braces for placement on a golf bag, said bracket comprising an upper end with an arcuate apex;

a clip portion which extends downwardly from said apex;

a center section attached to said apex and extending downwardly therefrom substantially parallel to said clip portion;

a pair of wing portions which diverge outwardly from the lower end of said center section; and a hook attached to each wing portion and extending upwardly therefrom.

16. Washing apparatus for golfers, comprising:

a flexible container formed of a liquid impermeable material for containing washing liquid and for receiving objects to be washed therein;

handle means operatively connected to said container for manipulating the container;

support means for suspending said container and said handle means from a golf bag and for restricting movement of the container relative to the golf bag when suspended therefrom; and a bracket operably attached to said support means for placement on a golf bag, said bracket comprising an upper end with an arcuate apex;

a clip portion which extends downwardly from said apex;

a center section attached to said apex and extending downwardly therefrom substantially parallel to said clip portion;

a pair of wing portions which diverge outwardly from the lower end of said center section; and a hook attached to each wing portion and extending upwardly therefrom.

* * * * *